United States Patent [19]

Price

[11] Patent Number: 4,808,139

[45] Date of Patent: Feb. 28, 1989

[54] GLOVE PUPPET AND A KIT FOR A PUPPET SHOW

[75] Inventor: Maya Price, Kibbutz Ein Dor, Israel

[73] Assignee: Ein Dor Kibbutz Hashomer Hatzair L'Hityashvut Shitufit Beeravon Mugbal, Kibbutz Ein Dor, Israel

[21] Appl. No.: 914,251

[22] Filed: Oct. 2, 1986

[51] Int. Cl.[4] ..... A63H 3/14

[52] U.S. Cl. ..... 446/75; 446/327

[58] Field of Search ..... 446/100, 321, 327, 363, 446/901, 268, 75, 372, 391

[56] References Cited

U.S. PATENT DOCUMENTS

| | | | |
|---|---|---|---|
| 1,535,925 | 4/1925 | Lee | 446/100 |
| 2,195,127 | 3/1940 | Brucker | 446/321 |
| 2,302,349 | 11/1942 | Renshaw | 446/327 |
| 3,075,677 | 1/1963 | Meisenberg | 446/268 |
| 3,564,807 | 2/1971 | Brieske | 446/327 |
| 3,811,220 | 5/1974 | Glass et al. | 446/321 |
| 3,864,871 | 2/1975 | Kaelin | 446/327 |
| 4,010,570 | 3/1977 | Kohler | 446/327 |
| 4,122,628 | 10/1978 | Crowell et al. | 446/100 |
| 4,504,240 | 3/1985 | Thomas | 446/100 |

*Primary Examiner*—Mickey Yu
*Assistant Examiner*—Sam Rimell
*Attorney, Agent, or Firm*—Holman & Stern

[57] ABSTRACT

A glove puppet having interconnected front and back surfaces sides outlining at least the contours of front and back sides of a head of a figure, two upper limbs of a figure and a sleeve. At least portions of the front and back surfaces are made of a material to which hooks of a hook and loop type pile fastener will adhere. A kit for a puppet show including the glove puppet and a plurality of feature elements is also provided.

2 Claims, 1 Drawing Sheet

GLOVE PUPPET AND A KIT FOR A PUPPET SHOW

The present invention relates to a glove puppet and to a kit for a puppet show incorporating the glove puppet.

Glove puppets or other type puppets for a puppet show are usually made of a head which is attached to a skirt-like body. The head comprises at least most of the characterising features which it is supposed to portray, such as eyes, nose, mouth, etc. and thus each puppet represents a substantially complete prestructured and designed image. Using such puppets in a puppet show, the operator or operators merely display each puppet at its turn in accordance with the told story and as the plot requires, and introduce or replace the acting puppets with other, readily available, ones. In some cases, the same puppet is further decorated or provided with additional external clothing elements or attachments such as hats, aprons, bags or even umbrellas.

This known type of a puppet show requires a substantial investment in a great number of puppets, each representing a different character. Also, the multiplicity of puppets required for even one single show occupies a substantial volume thus making it very cumbersome in travel.

It is therefore a broad object of the present invention to ameliorate the above disadvantages and to provide a glove puppet and kit for a puppet show containing such glove puppets, which kit is versatile, does not occupy much space and is of relatively low cost.

In accordance with the present invention there is provided a glove puppet comprising interconnected front and back surfaces outlining at least the contours of front and back sides of a head and of a figure, two upper limbs of a figure and a sleeve wherein at least portions of said front and back surfaces are made of a material to which hooks of a hook and loop type pile fastener, such as VELCRO will adhere.

The invention further provides a kit for a puppet show comprising a glove puppet as set out above, a plurality of feature elements for said figure, said feature elements being provided with a plurality of the aforesaid hooks for selective attachment of said elements to said figure, and an openable casing containing said glove puppet and said elements.

The term "figure" used herein is intended to include the form, shape, configuration or likeliness resembling human beings, animals or other creatures.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
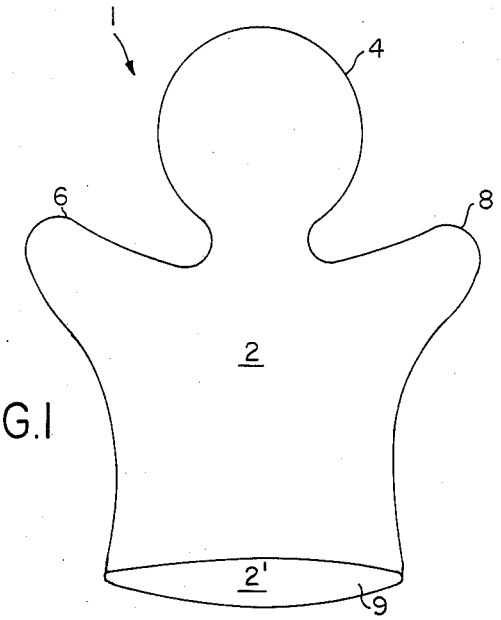
FIG. 1 is a schematic illustration of a glove puppet according to the invention.

Referring to FIG. 1, there is shown a glove puppet 1 made of two interconnected similar front and back surfaces 2, 2', outlining the contours of a head 4, of two upper limbs 6 and 8, and of a sleeve 9. Advantageously, the surfaces 2 and 2' are made of a material to which hooks of a hook and loop type pile fabric, such as VELCRO will adhere. Such material may be PERLON or any other commercially available fabric with a similarly finished surface having, e.g., raised loops or fleece suitable for catching on the aforesaid type hooks. The glove puppet schematically shown in this figure constitutes the basic, three-dimensional manipulatable medium which can be readily changed into endless configurations resembling human-beings, animals or objects. By a mere controlled twist of the palm of the operator's hand and the hand itself, each of the five sides of the puppet (the two major faces or sides as well as the two lateral edges and the edge along the top of the head) can be exposed to or hidden from, the onlooker's view.

Figure 2:
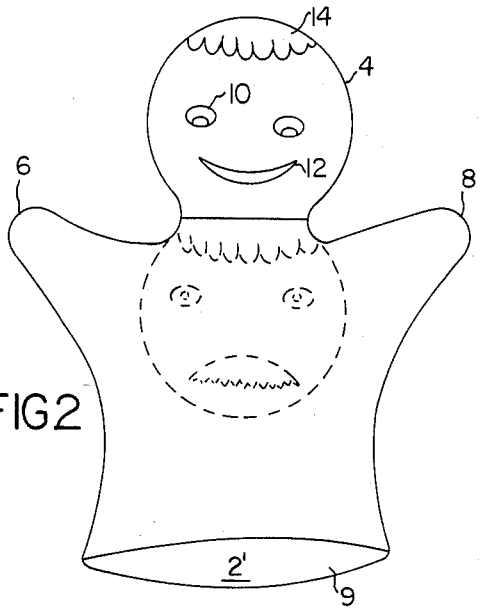
FIGS. 2 to 4 are schematic illustrations of the glove puppet of FIG. 1 with additional feature elements attached thereto showing a few possible manners of manipulation.
Figure 3:
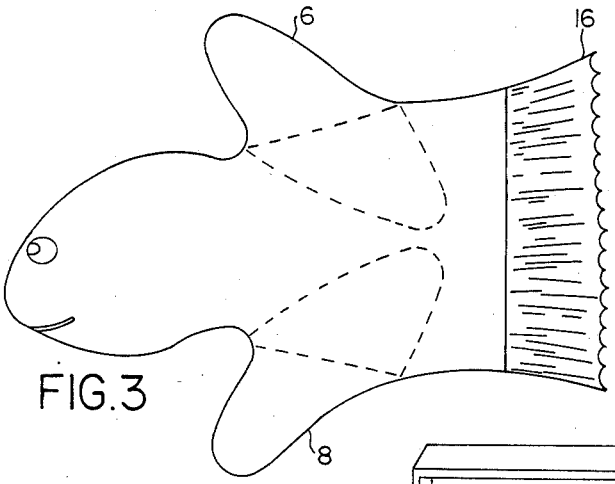
Figure 4:
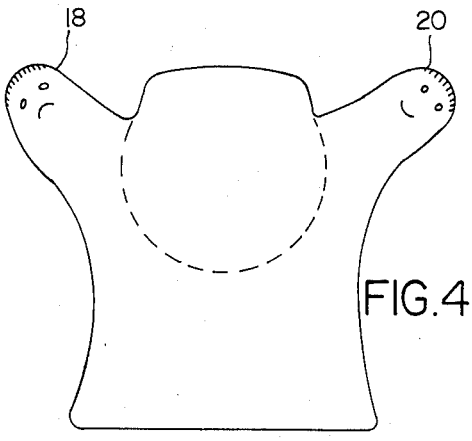

As can be seen in FIGS. 2 to 4, the glove puppet can be utilized in various diversified ways. Specifically, the head 4 can first be completed with feature elements, for example, eyes 10, a smiling mouth 12 and/or hair 14, which are suitably configured and designed elements having affixed thereon a plurality of the aforesaid type hooks adapted to adhere to the glove puppet outer surfaces and thereby to affix the feature elements thereto. In contradistinction to the commonly used puppets, the glove puppet of the present invention can be completed with different features on the front and back sides thereof so as to represent two characters appearing in one plot, e.g., the "good" smiling, image as shown in FIG. 2 by the full lines and the "bad" image as shown by the broken line in the same figure, which is merely the back of the head 4 when folded forward by the operator toward the body thereof.

In FIG. 3 there is shown an embodiment wherein the puppet is held in a horizontal position to simulate a fish-like image and for this purpose the limbs 6 and 8 are folded in, as shown by the dashed lines, and the puppets end, opposite to the head is fitted with a fish-tail feature element 16.

The great versatility of the glove puppet is further illustrated in FIG. 4. In view of the ease of attachment and detachment of the feature elements onto the surfaces of the puppet even during the manipulation of the same, a single puppet can be readily converted into twin characters 18 and 20 as illustrated in FIG. 4.

Figure 5:
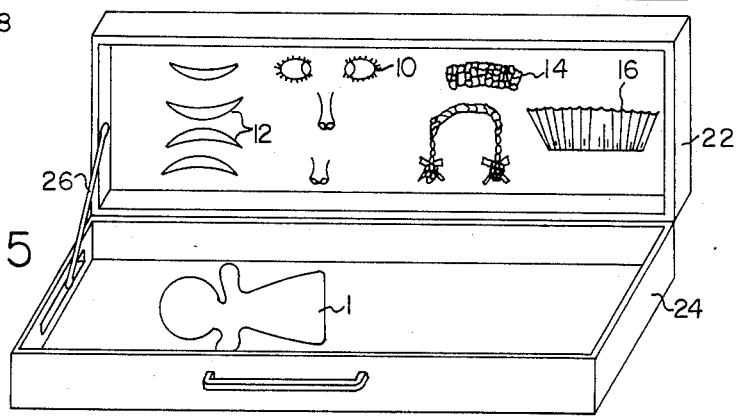
FIG. 5 shows a kit for a puppet show including a box-like structure containing the kit and the manner of use of the same.

Referring to FIG. 5, there is shown a kit for a puppet show which comprises one or more of the glove puppets 1 and a plurality of feature elements, e.g., eyes 10, mouths 12, hair 14, etc., which are orderly affixed onto the inner surface of the openable wall 22 of a box-like structure 24, which inner surface is lined with the same, or similar, material of which the puppets are made and to which the aforesaid type hooks adhere. Hence, as can be appreciated, the wall 22 having a support 26 for holding the wall 22 in its upright position, can serve as a front wall behind which the operator can manipulate the puppets during the show.

Obviously the glove puppet or some of the glove puppets in a kit can be pre-provided with at least some of the facial features of the image which they display and other feature elements can be added during the show.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A kit for a puppet show comprising a glove puppet including interconnected front and back surfaces outlining at least the contours of front and back sides of a head of a figure, a neck, two upper limbs of a figure extending from said neck and a sleeve, wherein at least portions of said front and back surfaces are made of a material to which hooks of a hook and loop type pile fastener will adhere, and wherein said head, neck and limbs each are independently manipulatable by an operator, a plurality of feature elements for said figure, said feature elements being provided with a plurality of hooks of a hook and loop type fastener for selective attachment of said elements to said figure, and an openable casing containing said glove puppet and said elements wherein at least some of the inner surfaces of said casing is lined with material to which hooks of a hook and loop type fastener will adhere, so as to facilitate the orderly placement of individual elements thereon said materials of the puppet and the casing being the same.

2. The kit as claimed in claim 1 wherein said casing is provided with stationary bottom and side walls and an openable top wall, said openable top wall being provided with means for affixing the same in an upright open position constituting a front wall behind which the operator can manipulate the puppets during the show.

* * * * *